US008094844B2

(12) United States Patent
Sung

(10) Patent No.: US 8,094,844 B2
(45) Date of Patent: Jan. 10, 2012

(54) MICRO ACOUSTIC TRANSDUCER AND MANUFACTURING METHOD THEREFOR

(75) Inventor: Po-Hsun Sung, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 1407 days.

(21) Appl. No.: 11/649,233

(22) Filed: Jan. 4, 2007

(65) Prior Publication Data

US 2007/0160248 A1 Jul. 12, 2007

(30) Foreign Application Priority Data

Jan. 6, 2006 (TW) ..... 95100667 A
Dec. 18, 2006 (TW) ..... 95138475 A

(51) Int. Cl.
*H04R 25/00* (2006.01)

(52) U.S. Cl. ..... 381/191; 381/173; 381/174

(58) Field of Classification Search ..... 381/173–174, 381/191; 367/181; 257/416–419; 438/52–53
See application file for complete search history.

(56) References Cited

U.S. PATENT DOCUMENTS 5,146,435 A 9/1992 Bernstein
5,163,329 A 11/1992 Shimaoka et al.
5,490,220 A * 2/1996 Loeppert ..... 381/355
6,535,460 B2 3/2003 Loeppert et al.
6,847,090 B2 1/2005 Loeppert
7,536,769 B2 * 5/2009 Pedersen ..... 29/594
2002/0106828 A1 * 8/2002 Loeppert ..... 438/53

FOREIGN PATENT DOCUMENTS

JP 20031-25495 A 4/2003
JP 2004-72368 A 3/2004

OTHER PUBLICATIONS

Chinese Office Action issued Sep. 14, 2010 in corresponding Taiwanese Patent Application No. 100098.

* cited by examiner

*Primary Examiner* — Davetta W Goins
*Assistant Examiner* — Matthew Eason
(74) *Attorney, Agent, or Firm* — Birch, Stewart, Kolasch & Birch, LLP

(57) ABSTRACT

A micro acoustic transducer and manufacturing method are provided. Firstly, a substrate having one first and second cavities is provided. Then, a backplate with a plurality of acoustic holes is formed on the substrate, and a diaphragm is formed on the backplate. An air gap is formed between the backplate and the diaphragm. The air gap, second cavity, and first cavity are communicated with each other through the acoustic holes. A plurality of rings is formed around the diaphragm. These rings are used to hitch pillars formed on the substrate or fasteners can be formed on the substrate for fastening the diaphragm on fastener holes. Through the arrangement of the rings or fasteners used as the boundary structure of the diaphragm, the mechanical sensitivity of the diaphragm is improved. Moreover, the backplate is supported by a single crystal structure formed by etching the substrate such that the stability is promoted.

30 Claims, 14 Drawing Sheets

MICRO ACOUSTIC TRANSDUCER AND MANUFACTURING METHOD THEREFOR

CROSS-REFERENCE TO RELATED APPLICATIONS

This non-provisional application claims priorities under 35 U.S.C. §119(a) on Patent Application No(s). 095100667 and 095138475 filed in Taiwan, R.O.C. on Jan. 6, 2006 and Oct. 18, 2006, the entire contents of which are hereby incorporated by reference.

BACKGROUND OF THE INVENTION

1. Field of Invention

The invention relates to an acoustic structure, and more particularly, to a micro acoustic transducer and a manufacturing method therefor.

2. Related Art

Micro acoustic transducers developed are mainly applied in various acoustic receivers and it has become an object of the design thereof to pursue characteristics such as small volume, low power consumption, and high sensitivity. Further, according to the result of theoretical modeling, it can be known that residual stress has a significant impact on the mechanical sensitivity of a diaphragm in an acoustic transducer. Under the influence of the residual stress, the boundary conditions of the diaphragm must be changed or a folding structure must be formed, so as to enhance the mechanical sensitivity of the diaphragm.

In U.S. Pat. No. 5,146,435, a basic microphone structure design declared as an acoustic transducer is included. The structure includes a perforated plate and a movable plate, wherein a dielectric fluid is contained there-between. The dielectric fluid is gas medium, air, or liquid, while the perforated plate and the movable plate are supported by a structure that functions as a spring. The shapes of the structures of the spring and the plate can be defined through a development process. The acoustic transducer can be combined with an oscillator circuit, such that the change in capacitance caused by the change in the space between the plates can be used as the base of the measurement of the acoustic transducer.

U.S. Pat. No. 5,163,329 discloses a sacrificial layer deposited between the diaphragm and a silicon substrate, such that the sacrificial layer and the substrate are etched by an etchant through etch holes to form a cavity structure.

In addition, U.S. Pat. No. 6,535,460 discloses an acoustic transducer, which comprises a substrate, a backplate, and a thin film structure. The backplate comprises a flat surface having a hole with an aspect ratio and a support structure. The support structure of the backplate is a continuous structure or bump. The floating thin film structure is supported by the support structure and fixedly spaced from the backplate. As such, when an acoustic wave reaches, the floating thin film structure moves freely in the direction perpendicular to the plane.

However, according to the result of theoretical modeling, residual stress plays a significant impact on the mechanical sensitivity of a diaphragm in an acoustic transducer. Under the influence of the residual stress, the boundary conditions of the diaphragm must be changed or a folding structure must be formed, so as to enhance the mechanical sensitivity of the diaphragm; therefore, how to provide a structure and method for a diaphragm to achieve a better stress-releasing effect and improve the property of a microphone component become an important issue.

SUMMARY OF THE INVENTION

An object of the invention is to provide a micro acoustic transducer to overcome the technology problems in prior art. A structure of rings is used as a boundary condition to enhance the mechanical sensitivity of a thin film. Besides, a substrate of a single crystal support structure is formed on the backplate structure to support the backplate, thereby enhancing firmness and solving the problems existing in the prior art.

An object of the invention is to provide a method of manufacturing micro acoustic transducer to overcome another technology problems in prior art. In order to enhance the stability of the structure of the backplate, the invention provides a method to define acoustic hole regions with sacrificial layers, such that the substrate is etched into a single crystal support structure to support the backplate.

An object of the invention is to provide a micro acoustic transducer which utilizes a fastening structure for releasing stress and restricting diaphragm to overcome another technology problems in prior art.

Therefore, in order to achieve the aforementioned object, the micro acoustic transducer disclosed in the invention includes a substrate with at least one first cavity and one second cavity above the first cavity, wherein the first cavity and the second cavity are communicated with each other; a backplate formed on the substrate, wherein the backplate has a plurality of acoustic holes; a diaphragm formed above the backplate, wherein a plurality of rings is formed around the diaphragm; and a plurality of pillars formed on the substrate, wherein the position of each pillar corresponds to that of each ring, respectively. An air gap is formed between the diaphragm and the backplate. The air gap, the second cavity, and the first cavity are communicated with each other through the acoustic holes. Each of the rings hitches the corresponding pillar, wherein the diameter of each ring is larger than that of each pillar.

Such design provides a support condition similar to a free boundary. The pillars are only used to limit the moving range of the diaphragm on the plane, while the support structure of the free boundary is mainly designed for releasing the residual stress generated in the process of the deposition of the diaphragm.

On the other hand, the method of manufacturing the micro acoustic transducer disclosed in the invention includes firstly providing a substrate with at least one first cavity and one second cavity, wherein the first cavity and the second cavity are communicated with each other and the second cavity is located on the first cavity; then, forming a backplate with a plurality of acoustic holes on the substrate; forming a diaphragm on the backplate, wherein a plurality of rings are formed around the diaphragm and an air gap is formed between the diaphragm and the backplate; and forming pillars on the substrate, wherein each of the rings hitches each of the pillars correspondingly and the position of each pillar corresponds to that of each ring.

The air gap, the second cavity, and the first cavity are communicated with each other through each of the acoustic holes and each of the rings hitches the corresponding pillar, respectively. The diameter of each ring must be larger than that of the corresponding pillar. As such, under the effect of the acoustic wave, the diaphragm vibrates due to the design of the free boundary.

In addition, the invention also provides a micro acoustic transducer which utilizes a fastening structure for releasing stress and limiting diaphragm. The micro acoustic transducer utilizing a fastening structure includes a substrate, a backplate, a diaphragm, a plurality of fasteners, and a plurality of supporting element. The substrate has at least one first cavity and a second cavity formed above the first cavity, and the first cavity and the second cavity is communicated with each other. The backplate is formed on the substrate and has a plurality of acoustic holes. The diaphragm is formed above the backplate and a plurality of fastener holes is surrounded on the diaphragm. Besides, the plurality of fasteners is formed on the substrate, and the position of each fastener is corresponding to that of each fastener hole respectively. In addition, the plurality of supporting elements is formed on the diaphragm so as to support the diaphragm on the surface of the backplate; thereby, an air gap is formed between the diaphragm and the backplate. Through the acoustic holes, the air gap, the second cavity, and the first cavity are communicated with each other. And each fastener is fasten to the corresponding fastener hole respectively, so that a gap exists between each fastener hole and each fastener respectively and the gap is provided for diaphragm's moving.

The micro acoustic transducer provided by the invention is directed to enhancing the sensitivity of the micro acoustic transducer. When the acoustic wave is transmitted, the capacitance value changes due to the structural distortion of diaphragm caused by the change of sound pressure, so as to read the signal of the acoustic wave. As for the design of the structure, a diaphragm structure with high sensitivity and a backplate structure that is kept to be a plane are desired to form a capacitor structure with a thin film structure.

As for the design of the diaphragm structure, a sacrificial layer is deposited on the under layer of the diaphragm structure. The pillars and a diaphragm structure surrounded by the ring structures are grown above the sacrificial layer. After the sacrificial layer is etched, the diaphragm is released and the diaphragm structure generates the support boundary condition similar to the free boundary through the design of the rings. The pillars are only used to limit the moving range of the diaphragm on the plane, while the support structure of the free boundary is mainly designed for releasing the residual stress generated in the process of depositing the diaphragm. Furthermore, the pillar may have a stop part to prevent the thin film drifting away during etching process. According to the theoretical modeling, the oscillation sensitivity of a diaphragm under no stress is 100 times more than that under residual stress of 100 MPa.

The above-mentioned diaphragm after releasing the residual stress may use the fastener structure to limit its moving range on the plane, which means that the diaphragm not only may release the residual stress by the mentioned design but also may use the fastener to fix it. Besides, the vibration may be controlled by the supporting element of the diaphragm.

On the other hand, in order to achieve the design of the backplate structure that is kept to be a plane, in many conventional arts, the stiffness of the backplate structure is enhanced through folding of the structure, doped silicon used as an etch stop layer, or a single crystal structure of silicon used as the backplate structure. In the invention, after the substrate is etched to a certain depth by backside etching, the sacrificial layer and the substrate are etched on the front side through etch holes to form a backplate support structure with acoustic holes, because the backplate structure supported by the single crystal structure helps to strengthen the stability of the backplate structure.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given herein below for illustration only, and which thus is not limitative of the invention, and wherein.

DETAILED DESCRIPTION OF THE INVENTION

In order to make the objects, structures, features, and functions of the invention more comprehensible, preferred embodiments accompanied with figures are described in detail below. Both the foregoing general description about the invention and the following detailed description about the embodiments are exemplary and are intended to explain the principles of the invention, and provide further explanation of the Claims.

Figure 1:
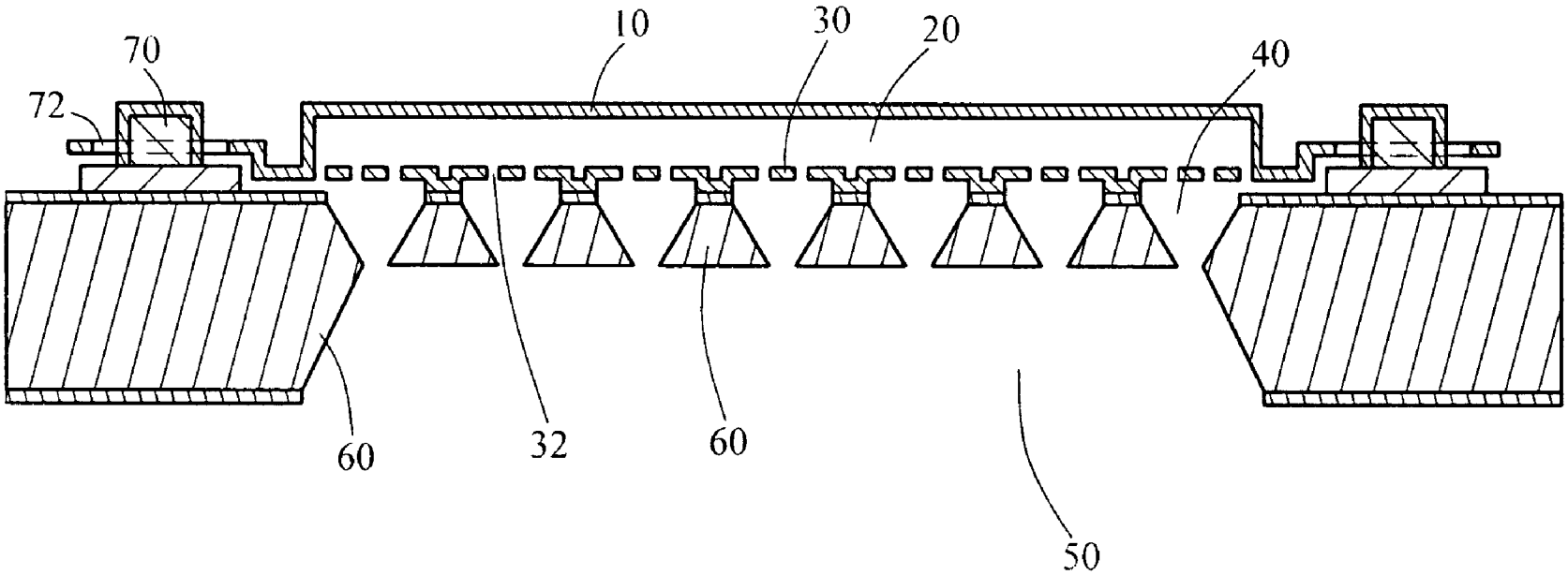
FIG. 1 is a schematic structural view of the micro acoustic transducer of a first embodiment of the invention.

Referring to FIG. 1, it is a schematic structural view of the micro acoustic transducer of a first embodiment of the invention. The micro acoustic transducer comprises a substrate 60 such as a silicon substrate, a backplate 30 formed on the substrate 60, a diaphragm 10 formed above the backplate 30, and a plurality of pillars 70 formed on the substrate 60 and around the diaphragm 10. The shape of the diaphragm 10 is square, circular, finger-like, or any other shape. A plurality of rings 72 is formed around the diaphragm 10 to hitch the pillars. Each ring 72 hitches one corresponding pillar 70, but does not completely fix the pillar. The diameter of the hole of each ring is larger that that of each pillar, such that the diaphragm 10 is still a free thin film. The pillars 70 are only used to limit the moving range of the diaphragm 10 on the plane. Further, an air gap 20 is formed between the diaphragm 10 and the backplate 30 with multiple acoustic holes 32. A first cavity 50 and a second cavity 40 are formed in the substrate 60, and the first cavity 50, the second cavity 40, and the air gap 20 are communicated with each other through the acoustic holes 32.

Figure 2:
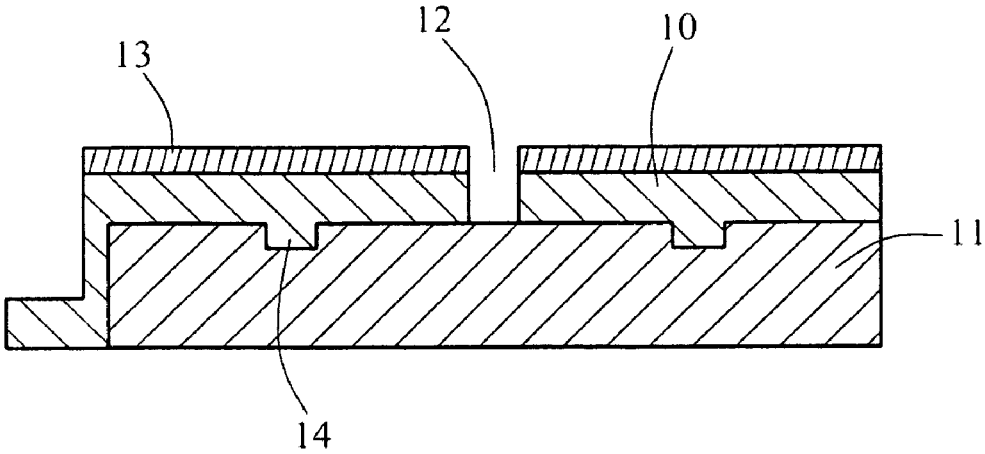
FIG. 2 is a schematic sectional view of the diaphragm of the micro acoustic transducer of the first embodiment of the invention.

Referring to FIG. 2, it is a schematic sectional view of the diaphragm of the micro acoustic transducer of the first embodiment of the invention. As shown in the figure, a diaphragm electrode layer 13 is further formed on the diaphragm 10 and multiple bumps 14 may be formed on the diaphragm 10. When a sacrificial layer 11 is processed by wet etching, with the bumps 14, the diaphragm 10 can be prevented from adhering to the backplate 30. After the first sacrificial layer 11 in the figure is etched, the air gap 20 is formed as shown in FIG. 1. Through each of etch holes 12 in the diaphragm 10, an etchant is poured in, such that the first sacrificial layer 11 is processed by wet etching.

Figure 3:
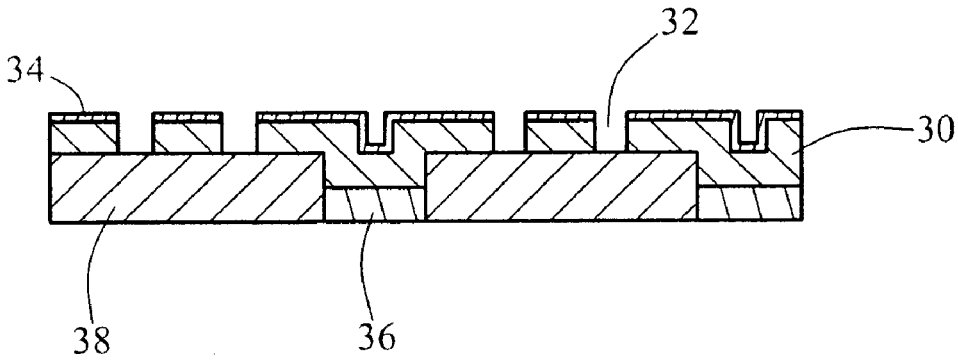
FIG. 3 is a schematic sectional view of the backplate of the micro acoustic transducer of the first embodiment of the invention.

Referring to FIG. 3, it is a schematic sectional view of the backplate of the micro acoustic transducer provided of the first embodiment of the invention. It can be seen from the figure that a backplate electrode layer 34 is further formed on the backplate 30 and a plurality of acoustic holes 32 is defined in the backplate 30, wherein the positions of the acoustic holes 32 correspond to the distribution position of a second sacrificial layer 38. During manufacturing, an etch mask 36 is formed on the surface of the substrate 60 and the material of the etch mask 36 may be silicon nitride or silicon oxide. The distribution shape and position of the etch mask 36 are defined with a mask. After that, the second sacrificial layer 38 is filled in the parts on the substrate where there is no mask layer 36. When the first etchant flows in through the etch holes 12, the first sacrificial layer 11 is first etched. Then, the second etchant continues to flow into each of the acoustic holes 32 to etch the second sacrificial layer 38 and then etch a part of the substrate 60 thereunder, thereby forming the second cavity 40.

Figure 4A:
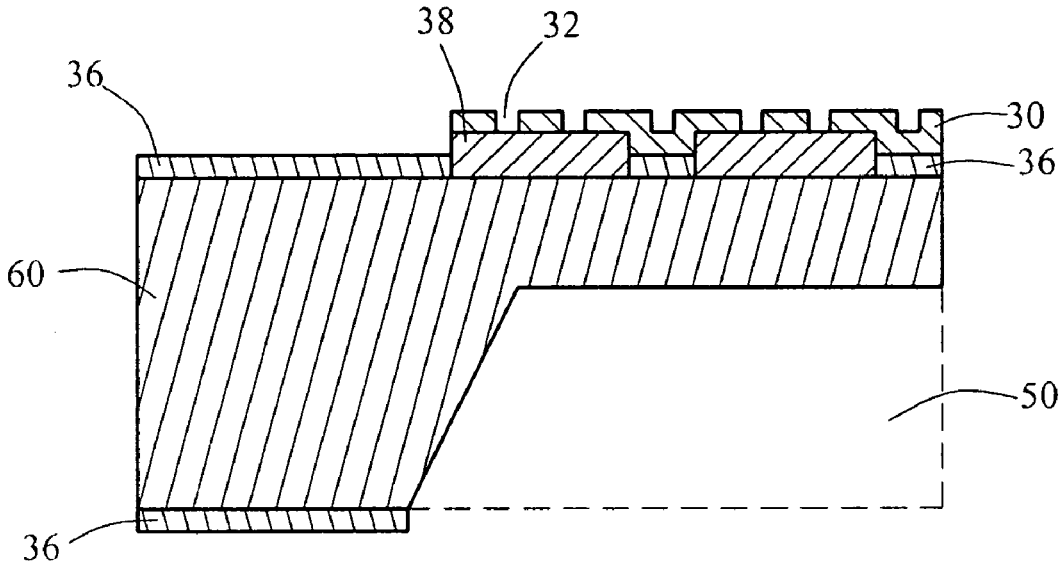
FIGS. 4A, 4B, and 4C are flow charts of forming the first cavity and the second cavity of the first embodiment of the invention.
Figure 4B:
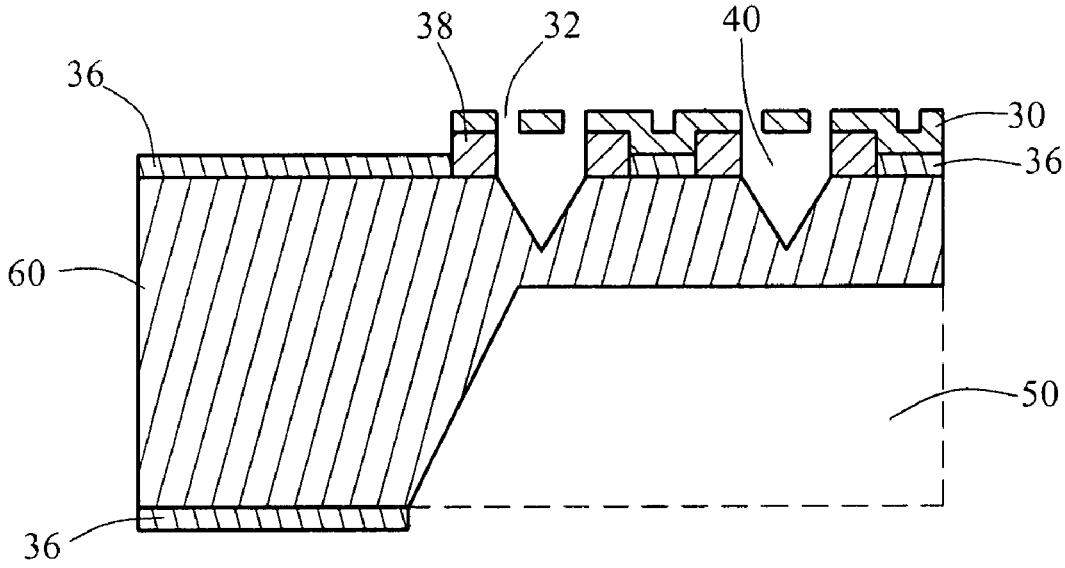
Figure 4C:
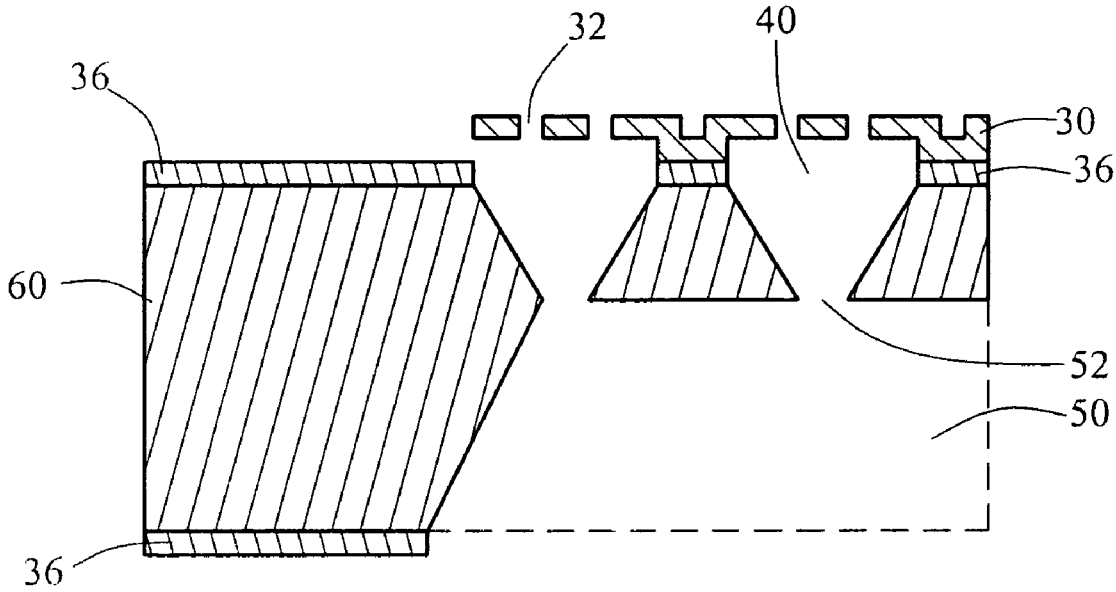

Referring to FIGS. 4A, 4B, and 4C, flow charts of forming the first cavity and the second cavity of the first embodiment of the invention are shown. First, the substrate 60 is etched to a certain depth by backside etching to form a first cavity 50. After that, the first etchant is poured into each of the etch holes 12, so as to etch the first sacrificial layer 11 by frontside etching. Then, the second etchant continues to flow down through each of the acoustic holes to etch the second sacrificial layer 38 and a part of the substrate 60 thereunder, thereby forming the second cavity 40. The first cavity 50 must be communicated with the second cavity 40 and the boundary of the first cavity 50 and the second cavity 40 is defined to be a cavity-connecting hole 52.

Figure 5A:
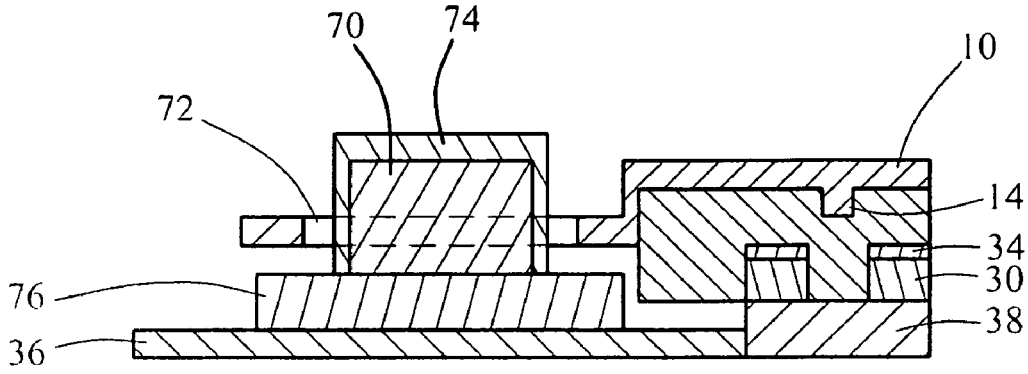
FIG. 5A is a sectional structure view of the pillar and the ring of the first embodiment of the invention.
Figure 5B:
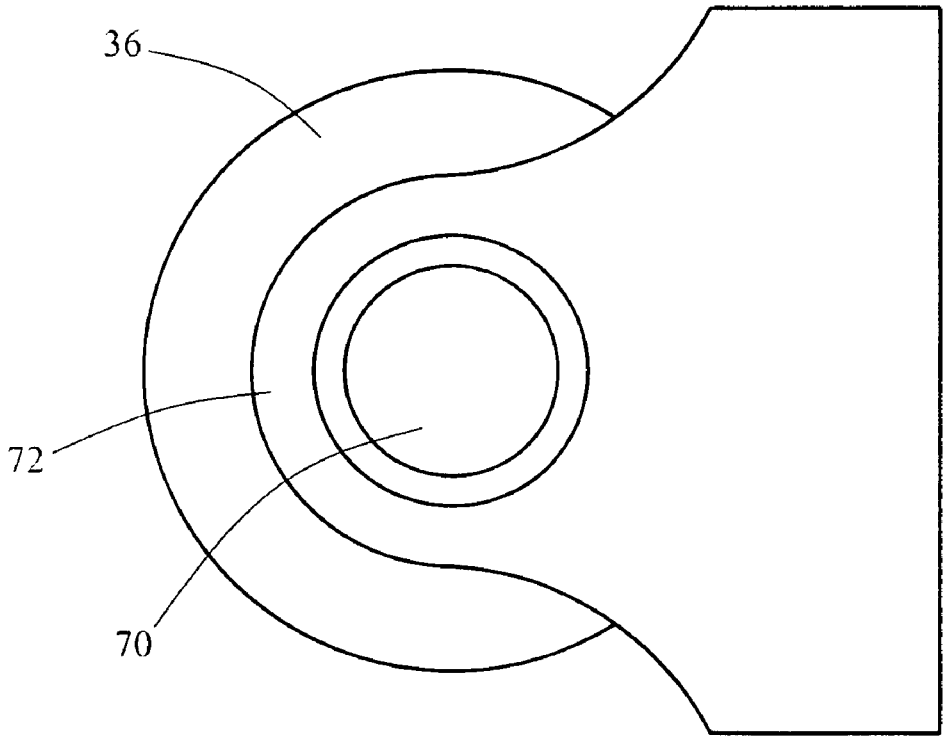
FIG. 5B is a top view of the pillar and the ring of the first embodiment of the invention.
Figure 6:
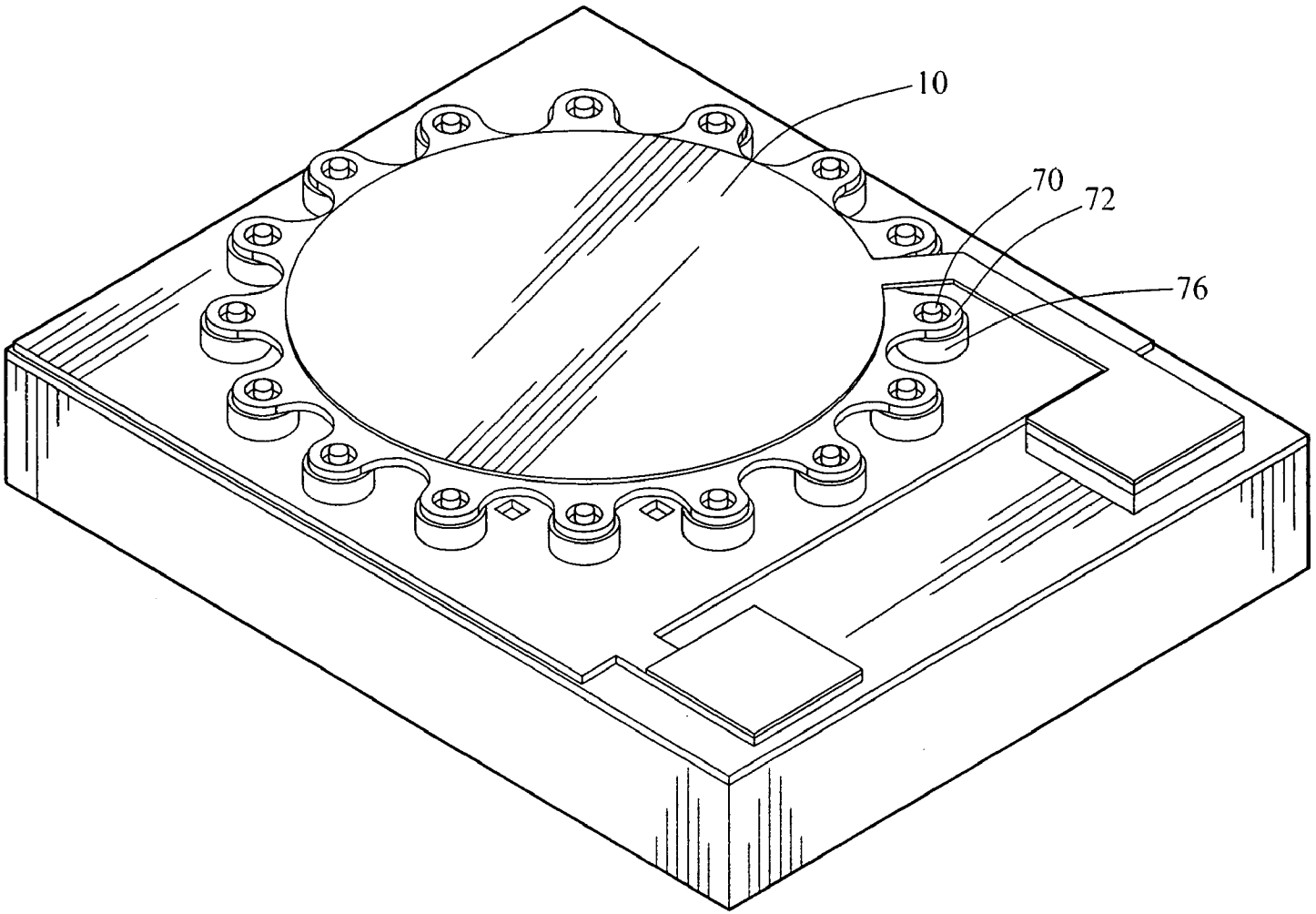
FIG. 6 is a stereogram of the micro acoustic transducer with a circular diaphragm of the invention.

As shown in FIG. 5A, it is a sectional structure view of the pillar and the ring of the first embodiment of the invention. As shown in the figure, a pillar protection layer 74 is coated on the outmost of the pillar 70 and a pillar base 76 is under the pillar 70 to serve as the substrate of the pillar 70. The diameter of the hole of the ring 72 must be larger than that of the pillar 70. That is, the ring 72 does not closely fit the pillar 70 and a space must be left between the ring 72 and the pillar 70, such that the diaphragm 10 vibrates under the effect of the acoustic wave. Referring to FIG. 5B, it is a top view of the pillar and the ring of the first embodiment of the invention. As shown in FIG. 5B, the pillar 70 does not completely adhere to the ring 72. FIG. 6 is a stereogram of the micro acoustic transducer with a circular diaphragm.

Figure 7:
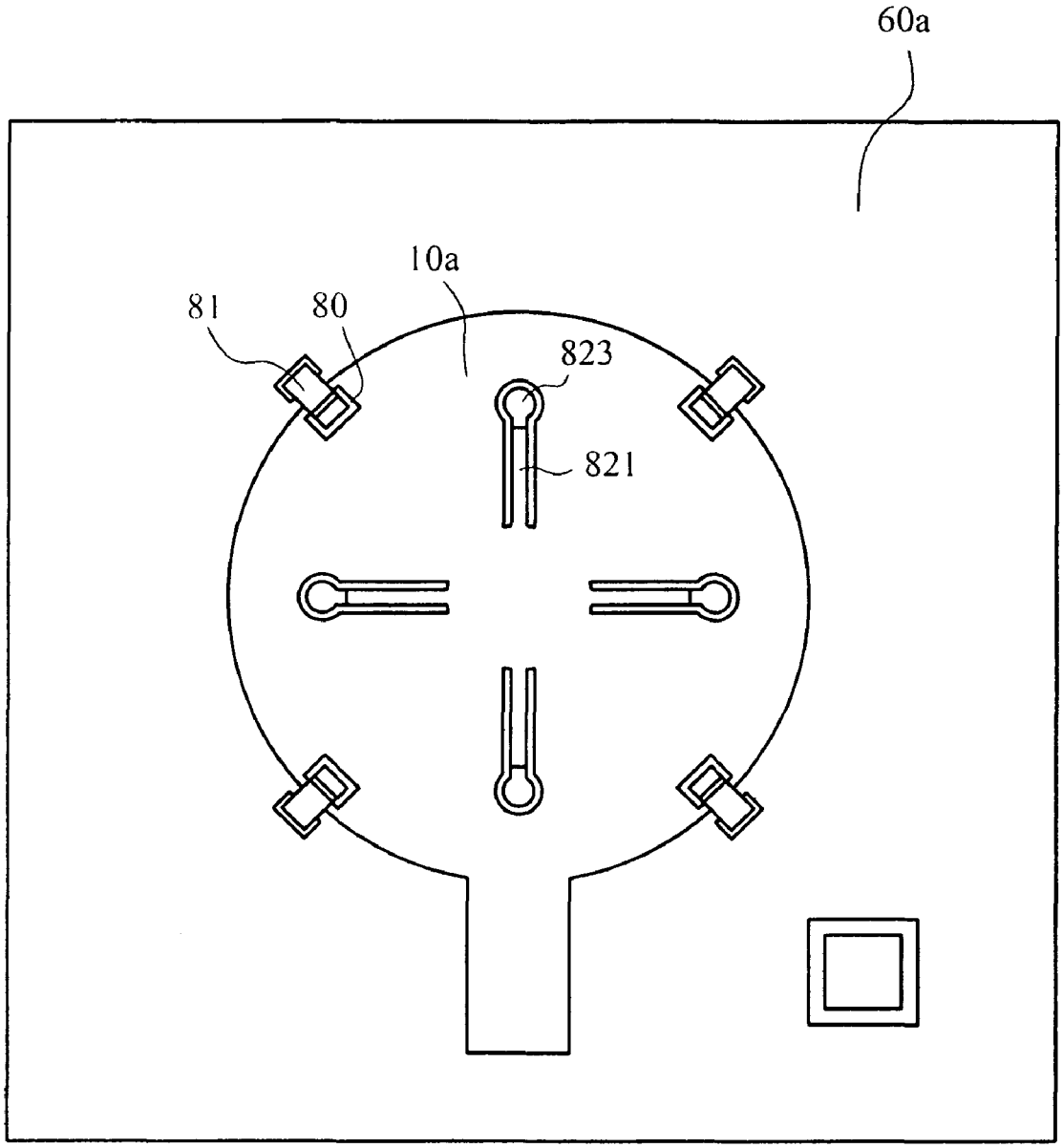
FIG. 7 is a top view of the micro acoustic transducer of a second embodiment of the invention.
Figure 8:
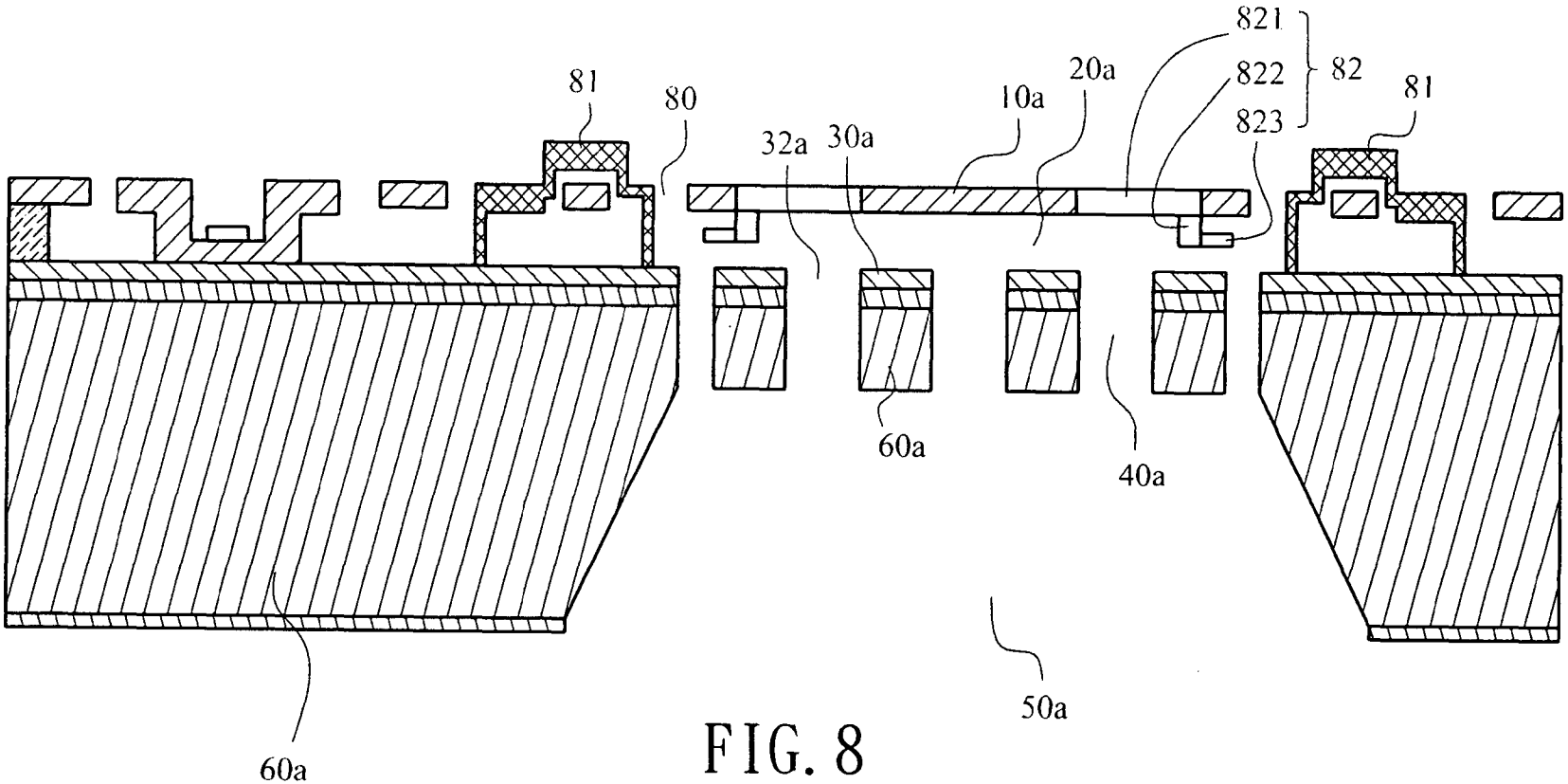
FIG. 8 is a schematic sectional view of FIG. 7.
Figure 9:
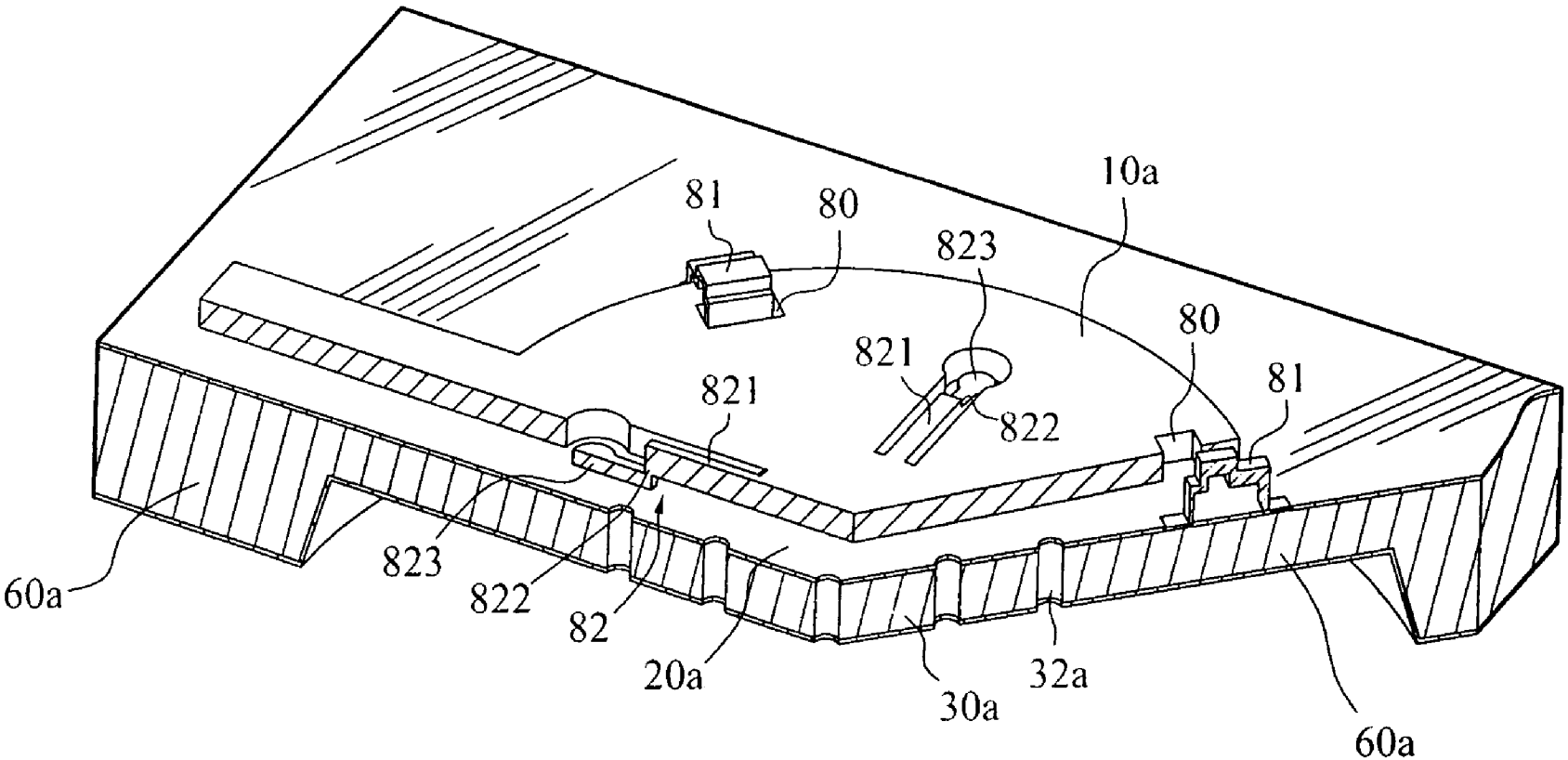
FIG. 9 is a stereogram view of FIG. 7.
Figure 10A:
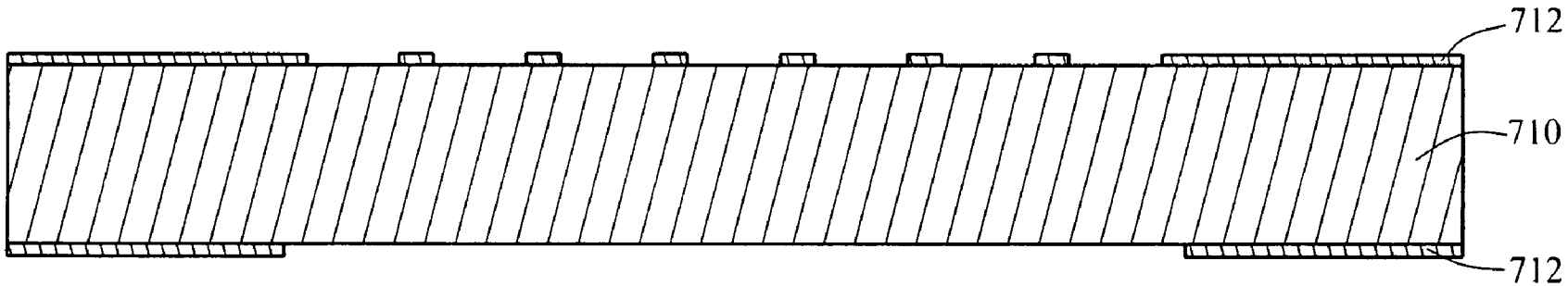
FIGS. 10A to 10I are flow charts of the method of manufacturing the micro acoustic transducer provided by the invention.
Figure 10B:
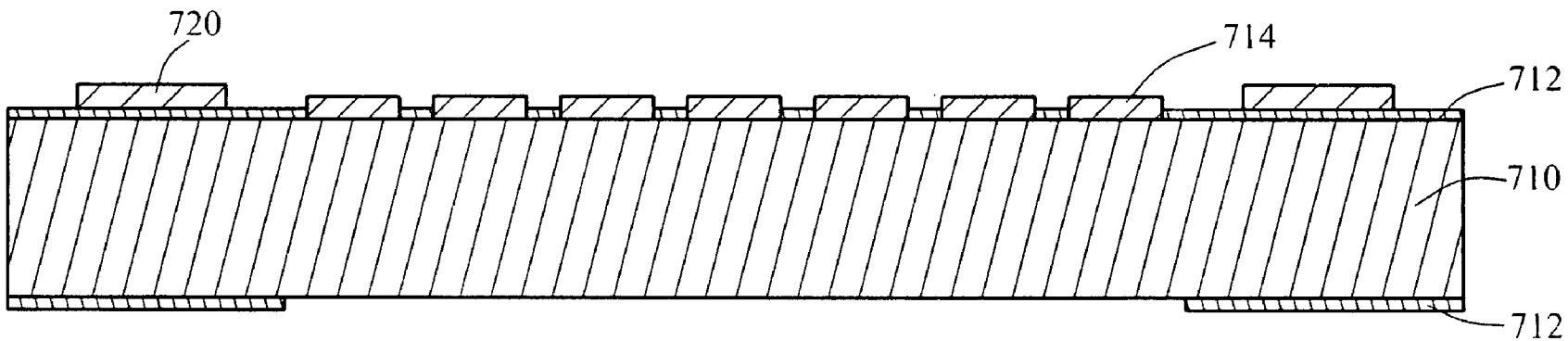
Figure 10C:
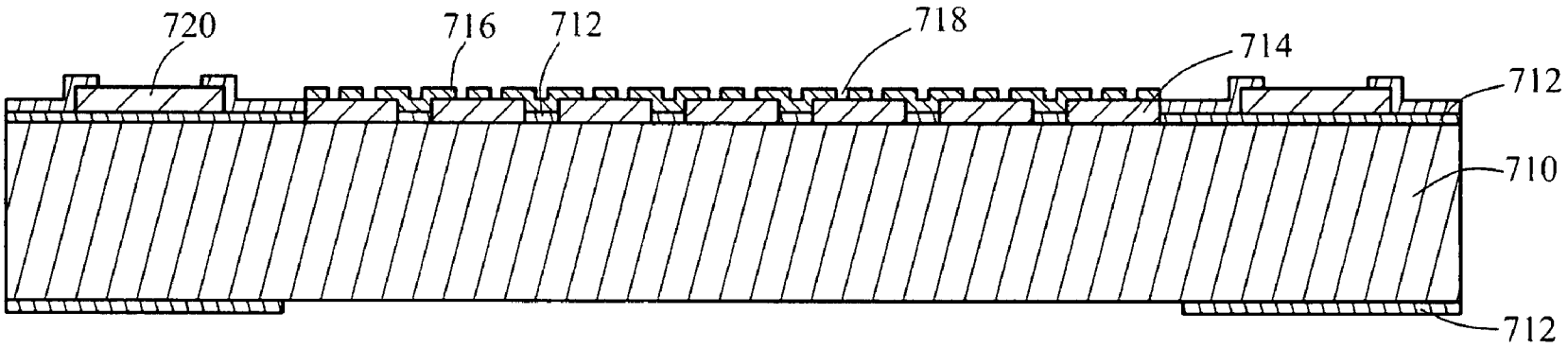
Figure 10D:
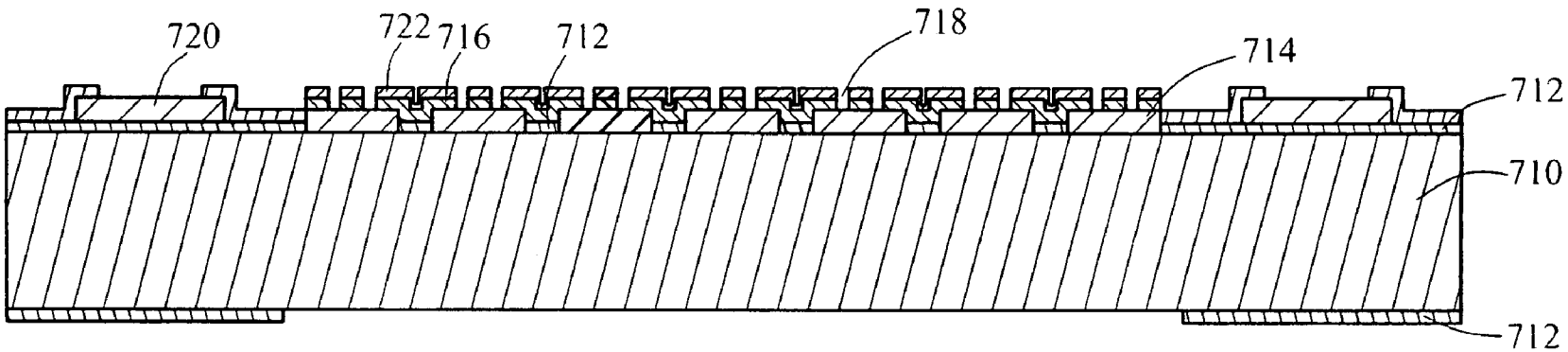
Figure 10E:
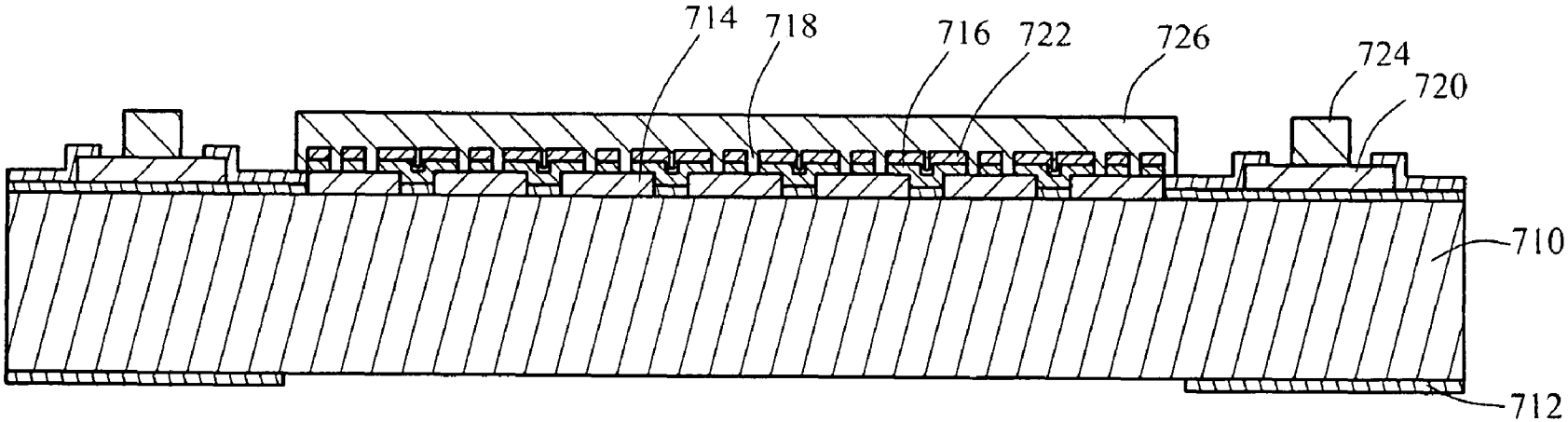
Figure 10F:
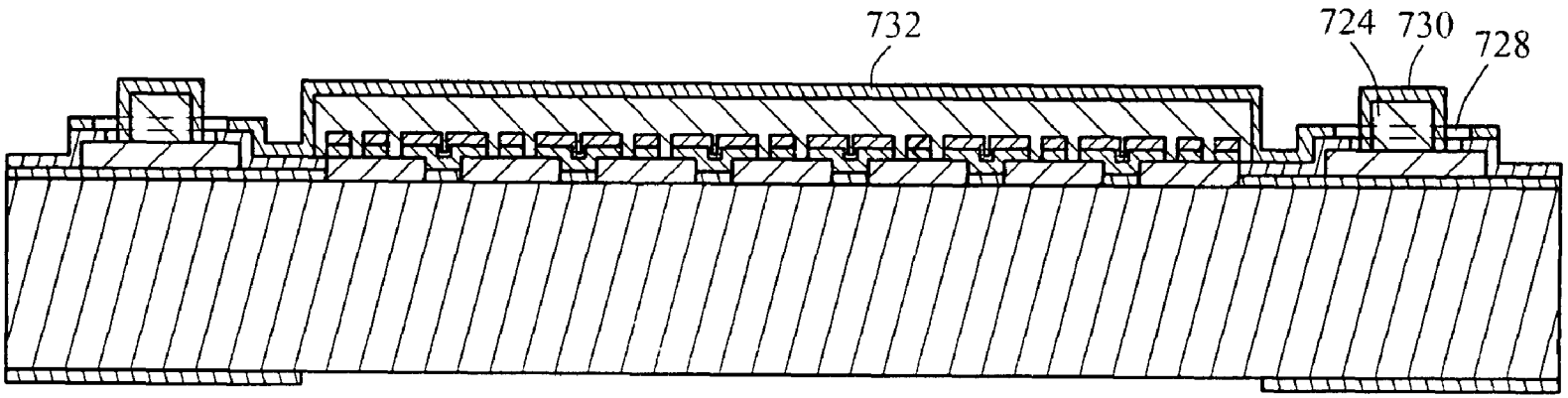
Figure 10G:
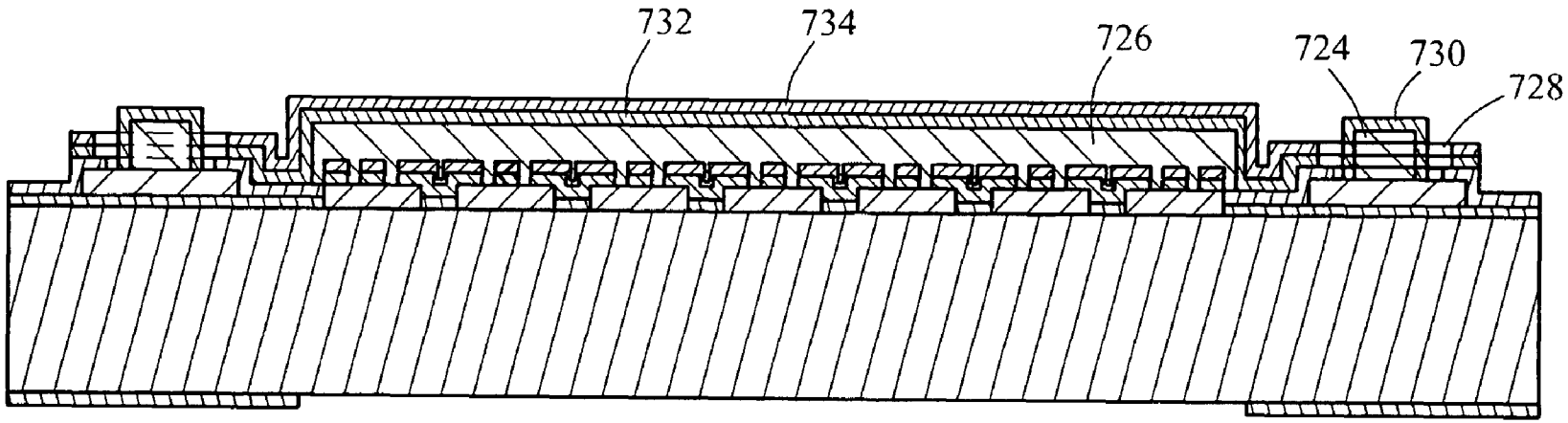
Figure 10H:
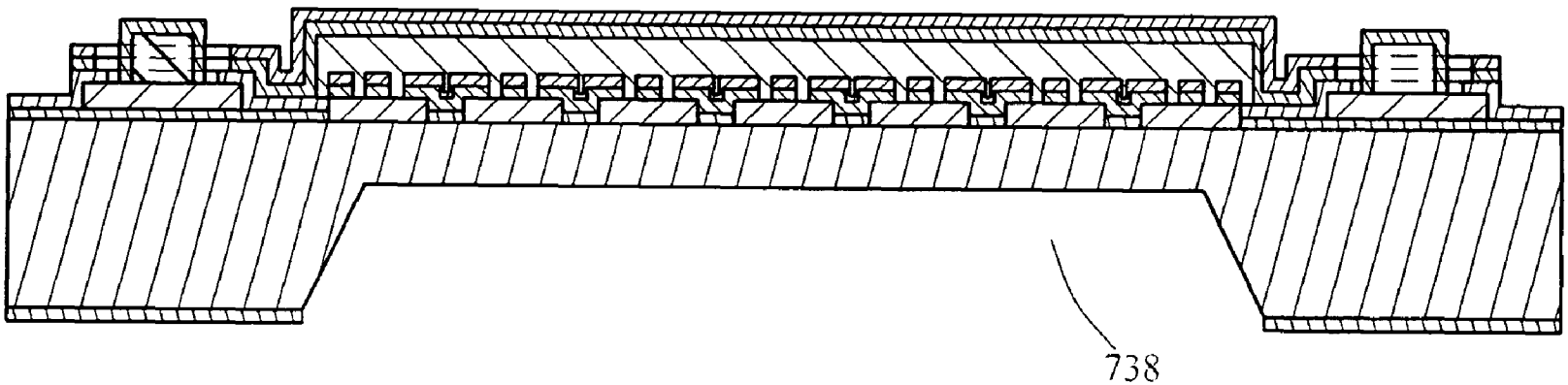
Figure 10I:
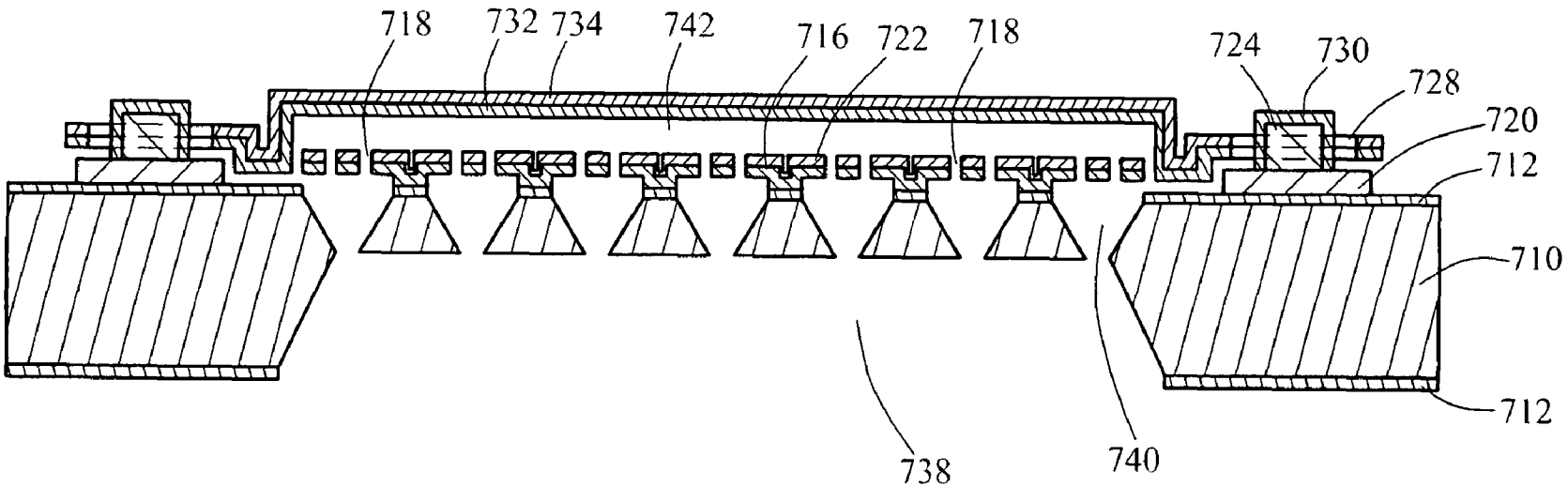

As shown in FIG. 7, it is a top view of the micro acoustic transducer of a second embodiment of the invention, FIG. 8 is a schematic sectional view of FIG. 7, and FIG. 9 is a stereogram view of FIG. 7. The micro acoustic transducer comprises a substrate 60*a* with at least one first cavity 50*a* and one second cavity 40*a* communicated with the first cavity 50*a*, a backplate 30*a* formed on the substrate 60*a* with multiple acoustic holes 32*a*, a diaphragm 10*a* formed on the backplate 30*a* with a plurality of fastener holes 80 around the diaphragm 10*a*, a plurality of fastener 81 formed on the substrate 60*a* and the position of each fastener 81 is corresponding to that of each fastener hole respectively, and a plurality of supporting element formed on the diaphragm 10*a*. The supporting element 82 includes a supporting rod 821 formed on the diaphragm 10*a*, a supporting pin 822 is vertically extended from the supporting rod 821, and a fixed end 823 is horizontally extended from the supporting rod 821. The supporting element 82 may support the diaphragm 10*a* on the surface of the backplate 30*a* in case. In addition, by the structure, an air gap 20*a* is formed between the diaphragm 10*a* and the backplate 30*a*. The air gap 20*a*, the second cavity 40*a*, and the first cavity 50*a* are communicated with each other through the acoustic holes 32*a*. Each of the fasteners 81 is fasten to each corresponding fastener hole 80, wherein the diameter of each fastener hole 80 is larger than that of each fastener 81, so that a space is provided between each fastener hole 80 and each fastener 81 respectively for the diaphragm 10*a* moving and also the design provides a movement limit structure for the diaphragm 10*a*.

Finally, referring to FIGS. 10A to 10I, flow charts of the method of manufacturing the micro acoustic transducer provided by the invention are shown. First, a substrate 710 is provided, wherein the substrate 710 is a silicon substrate. Etching masks 712 are coated on the upper surface and the lower surface of the substrate 710. A part of the etching mask 712 is etched firstly through the definition of the mask, so as to define the positions where the acoustic holes and the first cavity are to be formed.

Then, the frontside etching sacrificial layer 714 is filled in the part of the etching mask 712 which has been etched, and the pillar bases 720 are formed on both ends of the substrate 710. The position of the frontside etching sacrificial layer 714 corresponds to the positions of the acoustic holes. After that, the backplate 716 is formed thereon and defines a plurality of acoustic holes 718. Furthermore, a backplate electrode layer 722 is further formed on the backplate 716.

Subsequently, an air gap sacrificial layer 726 is coated on the back electrode layer 722 and the pillars 724 of the same material are formed on the pillar bases 720. Later, the air gap sacrificial layer 726 is etched to form an air gap.

Next, a diaphragm 732 is formed on the air gap sacrificial layer 726 and a pillar protection layer 730 of the same material is formed on the surface of the pillars. The structure of the rings 728 is formed around the pillars 724. After that, a diaphragm electrode layer 734 is further formed on the diaphragm 732.

Finally, the first cavity 738 is formed in the substrate 710 by backside etching. Then, the first etchant is poured into the etch holes to etch the air gap sacrificial layer 726 by frontside etching, so as to form the air gap 742. The first etchant flows down to etch each of the acoustic holes 718. Then the second etchant flows into each of the acoustic holes to etch the frontside etching sacrificial layer 714 and a part of the substrate 710 under the frontside etching sacrificial layer 714, thereby forming the second cavity 740, wherein the air gap 742, the first cavity 738, and the second cavity 740 are communicated with each other.

In the above-mentioned method, when a same material is utilized to form the pillar 724 in the pillar bases 720, the above-mentioned fastener 81 may be formed to replace the pillar 724. Besides, during the steps of the air gap sacrificial layer 726 coated on the back electrode layer 722 and the structure of the rings 728 being formed around the pillars 724, the above-mentioned fastener holes 80 may be used to replace the rings. Also, because the fastener 81 is fasten to the fastener hole 80 which has a diameter larger than that of the fastener 81, the fastener 81 may be used for limiting the range of movement of the diaphragm 10*a*.

In the invention, the rings hitch the pillars to form the support structures or the fasteners fastens to the fastener holes, thus achieving a diaphragm of releasing residual stress, and improving the performance of the micro acoustic transducer. On the other hand, the backplate structure supported by a single crystal is manufactured by backside silicon substrate etching and frontside sacrificial layer etching. The whole support structure is similar to an interlaced net rack support, thereby enhancing the firmness of the backplate structure. After the silicon substrate is etched to a certain depth by backside etching, the sacrificial layer and the silicon substrate are etched on the front side through the etch holes, so as to form the backplate support structure with the acoustic holes, which can be applied in the acoustic transducer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A micro acoustic transducer, comprising:

a substrate with at least one first cavity and one second cavity which is above the first cavity, wherein the first cavity and the second cavity are communicated with each other;

a backplate formed on the substrate, wherein the backplate has a plurality of acoustic holes;

a diaphragm formed on the backplate, wherein a plurality of rings is formed around the diaphragm; and a plurality of pillars formed on the substrate, wherein the position of each of the pillars corresponds to that of each of the rings, respectively;

wherein an air gap is formed between the diaphragm and the backplate, the air gap, the second cavity, and the first cavity are communicated with each other through each of the acoustic holes; each of the rings hitches the corresponding pillar, respectively; and the diameter of the hole of each ring is larger than that of each pillar.

2. The micro acoustic transducer as claimed in claim 1, wherein the substrate is a silicon substrate.

3. The micro acoustic transducer as claimed in claim 1, wherein the diaphragm has at least one bump for preventing the diaphragm adhering to the backplate.

4. The micro acoustic transducer as claimed in claim 1, further comprising a diaphragm electrode layer formed on the diaphragm.

5. The micro acoustic transducer as claimed in claim 1, further comprising a backplate electrode layer formed on the backplate.

6. The micro acoustic transducer as claimed in claim 1, wherein the diaphragm further comprises at least one etch hole through which an etchant is poured in.

7. The micro acoustic transducer as claimed in claim 1, further comprising an etch mask disposed on the surface of the substrate.

8. The micro acoustic transducer as claimed in claim 7, wherein the material of the etch mask is silicon nitride or silicon oxide.

9. The micro acoustic transducer as claimed in claim 1, wherein each of the pillars has a pillar base thereunder to serve as the substrate thereof.

10. The micro acoustic transducer as claimed in claim 1, wherein the backplate is supported by a single crystal structure formed through etching the substrate.

11. A micro acoustic transducer, comprising:

a substrate with at least one first cavity and one second cavity which is above the first cavity, wherein the first cavity and the second cavity are communicated with each other;

a backplate formed on the substrate, wherein the backplate has a plurality of acoustic holes;

a diaphragm formed on the backplate, wherein a plurality of fastener holes is formed around the diaphragm; and a plurality of fasteners formed on the substrate, wherein the position of each of the fasteners corresponds to that of each of the fastener holes, respectively;

a plurality of supporting element formed on the diaphragm for supporting the diaphragm on a surface of the backplate;

wherein an air gap is formed between the diaphragm and the backplate, the air gap, the second cavity, and the first cavity are communicated with each other through each of the acoustic holes; each of the fastener is fasten to the corresponding fastener hole, respectively; and the diameter of the fastener hole is larger than that of each fastener so that a space is provided between each fastener hole and each fastener respectively for diaphragm moving.

12. The micro acoustic transducer as claimed in claim 11, wherein the supporting element comprises a supporting rod formed on the diaphragm, a supporting pin vertically extended from the supporting rod, and a fixed end horizontally extended from the supporting rod.

13. The micro acoustic transducer as claimed in claim 11, wherein the substrate is a silicon substrate.

14. The micro acoustic transducer as claimed in claim 11, wherein the diaphragm has at least one bump for preventing the diaphragm adhering to the backplate.

15. The micro acoustic transducer as claimed in claim 11, further comprising a diaphragm electrode layer formed on the diaphragm.

16. The micro acoustic transducer as claimed in claim 11, further comprising a backplate electrode layer formed on the backplate.

17. The micro acoustic transducer as claimed in claim 11, wherein the diaphragm further comprises at least one etch hole through which an etchant is poured in.

18. The micro acoustic transducer as claimed in claim 11, further comprising an etch mask disposed on the surface of the substrate.

19. The micro acoustic transducer as claimed in claim 18, wherein the material of the etch mask is silicon nitride or silicon oxide.

20. The micro acoustic transducer as claimed in claim 11, wherein the backplate is supported by a single crystal structure formed through etching the substrate.

21. A method of manufacturing a micro acoustic transducer, comprising:

providing a substrate with at least one first cavity and one second cavity which is above the first cavity, wherein the first cavity and the second cavity are communicated with each other;

forming a backplate with a plurality of acoustic holes on the substrate;

forming a diaphragm on the backplate, wherein a plurality of rings are formed around the diaphragm; and forming a plurality of pillars on the substrate, wherein the position of each pillar corresponds to that of each ring;

wherein an air gap is formed between the diaphragm and the backplate, the air gap, the second cavity, and the first cavity are communicated with each other through each of the acoustic holes; each of the rings hitches each of the pillars, respectively; and the diameter of the hole of each ring is larger than that of each pillar.

22. The method of manufacturing the micro acoustic transducer as claimed claim 21, wherein the substrate is a silicon substrate.

23. The method of manufacturing the micro acoustic transducer as claimed claim 21, wherein at least one bump is formed on the diaphragm to prevent the diaphragm adhering to the backplate.

24. The method of manufacturing the micro acoustic transducer as claimed claim 21, wherein a diaphragm electrode layer is further formed on the diaphragm.

25. The method of manufacturing the micro acoustic transducer as claimed claim 21, wherein a backplate electrode layer is further formed on the backplate.

26. The method of manufacturing the micro acoustic transducer as claimed claim 21, wherein the diaphragm further comprises at least one etch hole through which an etchant is poured in.

27. The method of manufacturing the micro acoustic transducer as claimed claim 21, wherein an etch mask is further formed on the surface of the substrate.

28. The method of manufacturing the micro acoustic transducer as claimed claim 27, wherein the material of the etch mask is silicon nitride or silicon oxide.

29. The method of manufacturing the micro acoustic transducer as claimed claim 21, wherein each of the pillars has a pillar base thereunder to serve as the substrate thereof.

30. The method of manufacturing the micro acoustic transducer as claimed claim 21, wherein the backplate is supported by a single crystal structure formed through etching the substrate.

* * * * *

UNITED STATES PATENT AND TRADEMARK OFFICE

CERTIFICATE OF CORRECTION

PATENT NO. : 8,094,844 B2
APPLICATION NO. : 11/649233
DATED : January 10, 2012
INVENTOR(S) : Po-Hsun Sung It is certified that error appears in the above-identified patent and that said Letters Patent is hereby corrected as shown below:

ON THE TITLE PAGE:

Item (30), to read as follows:

Item -- (30) Foreign Application Priority Data

Jan. 6, 2006 (TW) ..... 95100667 A
Oct. 18, 2006 (TW) ..... 95138475 A --.

Signed and Sealed this
Twenty-sixth Day of June, 2012

David J. Kappos

David J. Kappos
*Director of the United States Patent and Trademark Office*